US008500669B2

(12) United States Patent
Sheu

(10) Patent No.: US 8,500,669 B2
(45) Date of Patent: Aug. 6, 2013

(54) PROTECTIVE CUP

(75) Inventor: Shing-Jiu Sheu, Taipei (TW)

(73) Assignee: Wellpower Sporting Goods Co., Ltd., Kowloon (HK)

( * ) Notice: Subject to any disclaimer, the term of this patent is extended or adjusted under 35 U.S.C. 154(b) by 65 days.

(21) Appl. No.: 13/343,838

(22) Filed: Jan. 5, 2012

(65) Prior Publication Data

US 2013/0178780 A1 Jul. 11, 2013

(51) Int. Cl.
*A61F 13/00* (2006.01)

(52) U.S. Cl.
USPC ..... 602/60; 602/72; 2/466

(58) Field of Classification Search
USPC ..... 602/60–61, 67, 70, 72; 2/466
See application file for complete search history.

(56) References Cited

U.S. PATENT DOCUMENTS

| | | | | |
|---|---|---|---|---|
| 4,453,541 | A * | 6/1984 | Castelli et al. | 602/72 |
| 5,479,942 | A * | 1/1996 | DiMatteo | 128/846 |
| 7,900,285 | B2 | 3/2011 | Steszyn et al. | |
| 2004/0024341 | A1 * | 2/2004 | Jacobs | 602/72 |
| 2008/0058693 | A1 * | 3/2008 | Lukens | 602/67 |
| 2009/0171260 | A1 * | 7/2009 | Lerma | 602/72 |

* cited by examiner

*Primary Examiner* — Michael A. Brown
(74) *Attorney, Agent, or Firm* — Dickstein Shapiro LLP

(57) ABSTRACT

A protective cup comprises: a molded cup-shaped main body having a peripheral edge, upper and lower segments, and an intermediate transition segment interconnecting the upper and lower segments, the peripheral edge having top and bottom sides, the upper segment extending curvedly from the top side of the peripheral edge to the intermediate transition segment, the lower segment extending curvedly from the intermediate transition segment to the bottom side of the peripheral edge, the lower segment having a wall thickness less than that of the upper segment; and an elastic pad body having a loop-shaped lip connected to the peripheral edge of the cup-shaped main body.

4 Claims, 9 Drawing Sheets

PROTECTIVE CUP

BACKGROUND OF THE INVENTION

1. Field of the Invention

This invention relates to a protective cup, more particularly to a protective cup having a cup-shaped main body having an upper segment and a lower segment with a wall thickness less than that of the upper segment.

2. Description of the Related Art

Protective cups have been used by athletes to protect the genital area of the wearer. Hence, the protective cup is required to be sufficiently rigid to retain its shape to provide the protection. However, the high rigidity of the protective cup can restrict movement of the wearer and result in discomfort for the wearer.

U.S. Pat. No. 7,900,285 discloses a protective cup that includes an upper portion and a lower portion. The lower portion is substantially solid, while the upper portion is formed with a plurality of slots for reducing the weight of the protective cup and increasing the flexibility and the ventilation of the protective cup. As such, the protective cup can alleviate the aforesaid drawbacks of restricting movement and causing discomfort to the wearer.

SUMMARY OF THE INVENTION

An object of the present invention is to provide a protective cup that can alleviate the aforesaid drawbacks of the prior art in a different manner.

According to the present invention, there is provided a protective cup that comprises: a molded cup-shaped main body of a resin material, the cup-shaped main body having a peripheral edge, upper and lower segments, and an intermediate transition segment interconnecting the upper and lower segments, the upper and lower segments and the intermediate transition segment cooperatively forming the cup-shaped main body, the peripheral edge having top and bottom sides, the upper segment extending curvedly from the top side of the peripheral edge to the intermediate transition segment, the lower segment extending curvedly from the intermediate transition segment to the bottom side of the peripheral edge, the lower segment having a wall thickness less than that of the upper segment so that the lower segment is more pliable than the upper segment and that the upper segment is more rigid than the lower segment; and an elastic pad body having a loop-shaped lip connected to the peripheral edge of the cup-shaped main body.

BRIEF DESCRIPTION OF THE DRAWINGS

In drawings which illustrate the embodiments of the invention.

DETAILED DESCRIPTION OF THE PREFERRED EMBODIMENTS

Figure 1:
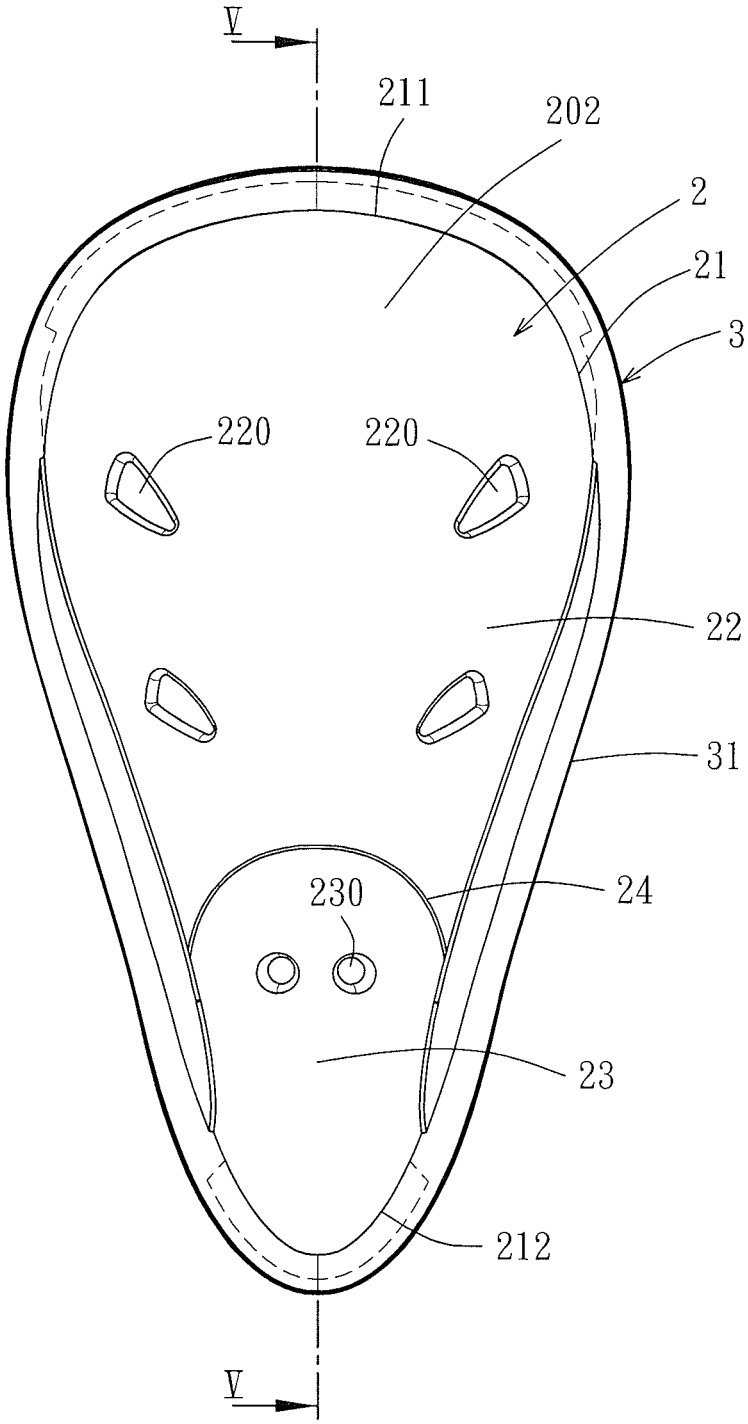
FIG. 1 is a front view of the first preferred embodiment of a protective cup according to the present invention.
Figure 2:
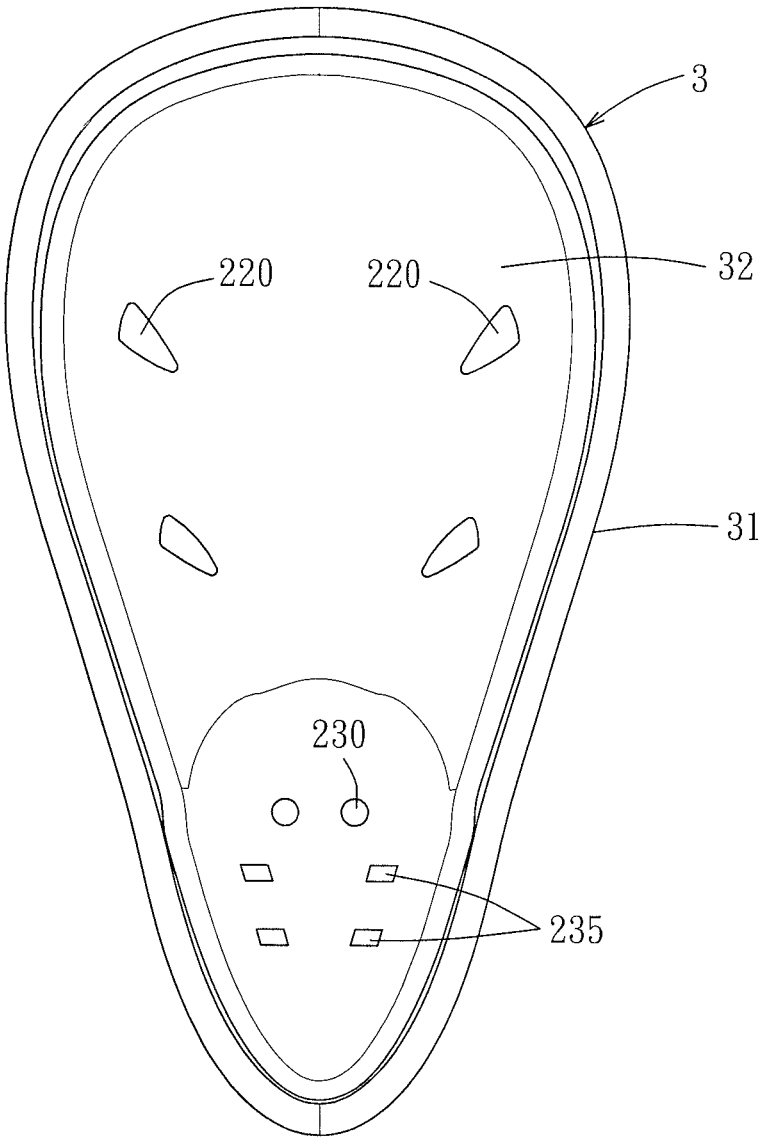
FIG. 2 is a back view of the first preferred embodiment.
Figure 3:
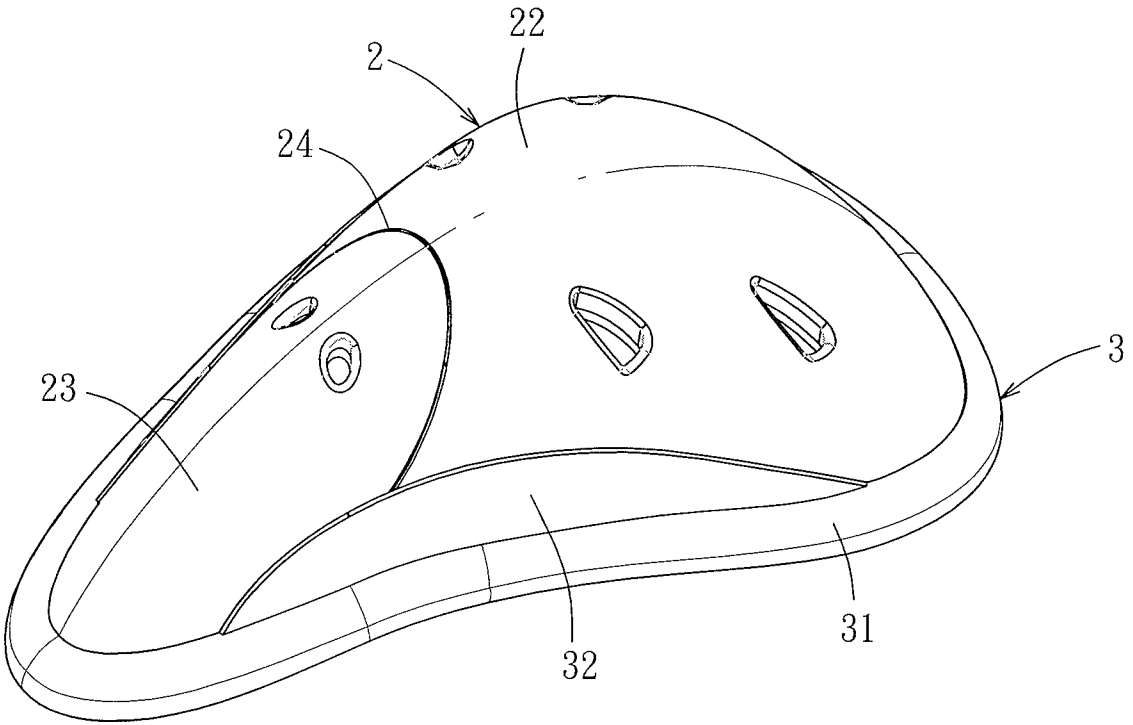
FIG. 3 is a perspective view of the first preferred embodiment.
Figure 4:
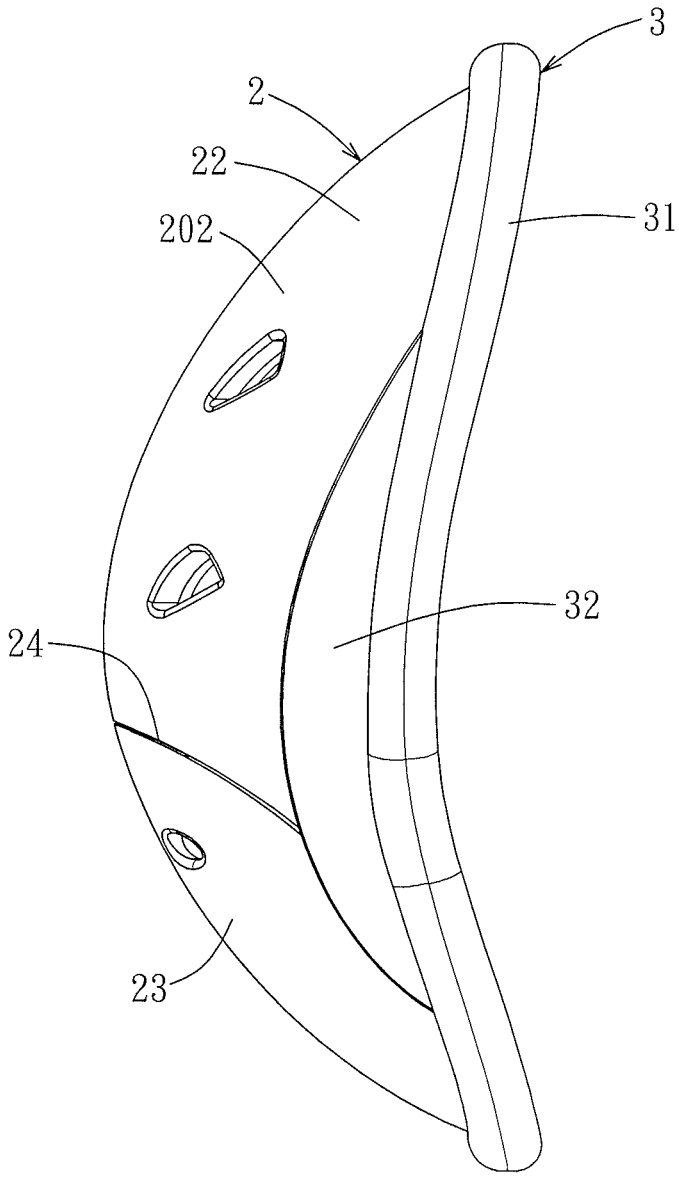
FIG. 4 is a side view of the first preferred embodiment.
Figure 5:
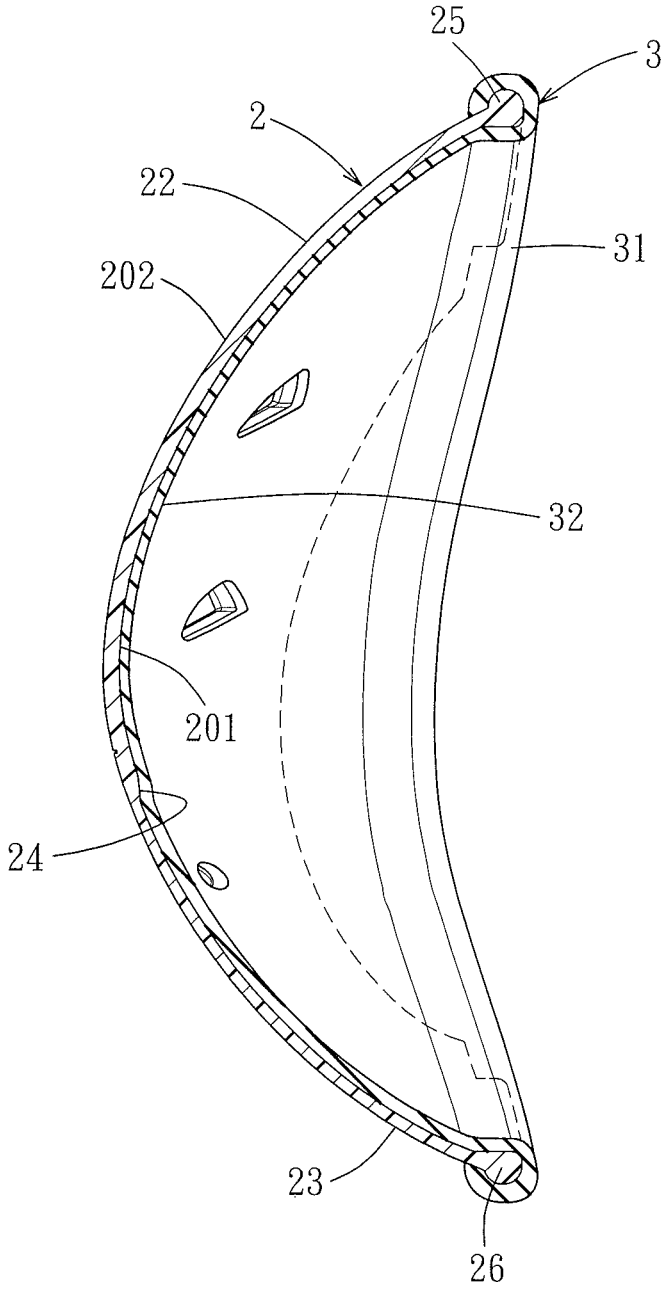
FIG. 5 is a sectional view taken along line V-V of FIG. 1.
Figure 6:
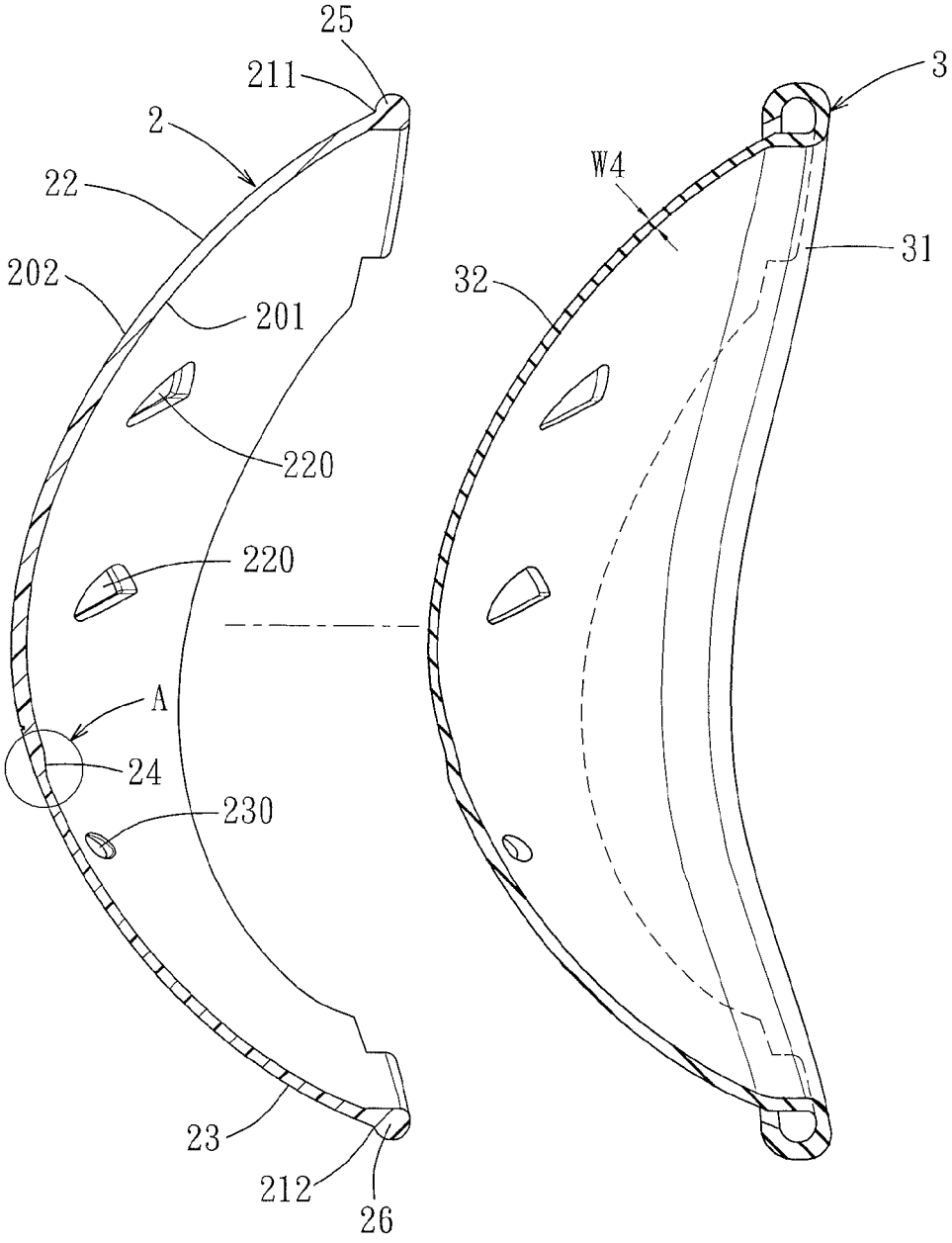
FIG. 6 is an exploded sectional view of the first preferred embodiment.
Figure 7:
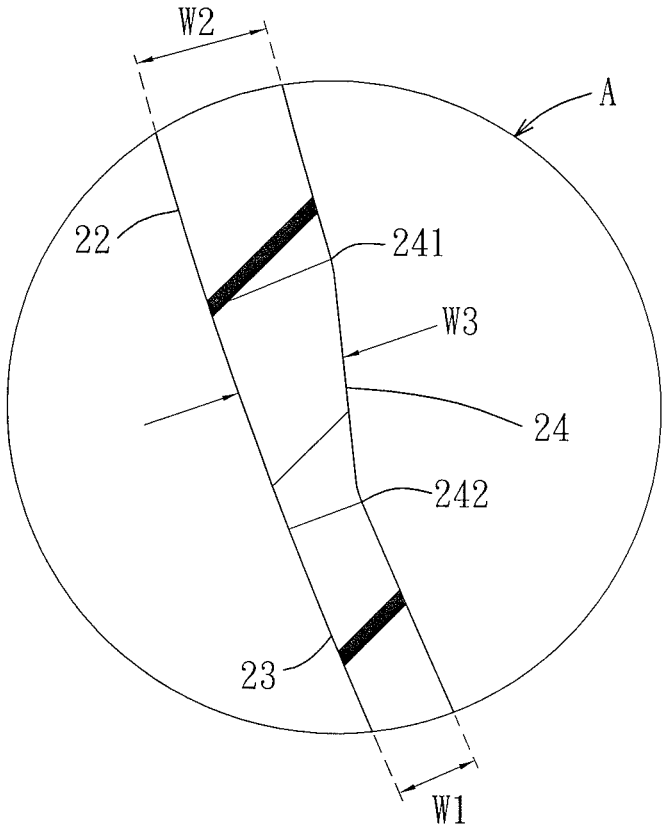
FIG. 7 is an enlarged view of a circled portion (A) in FIG. 6.

FIGS. 1 to 7 illustrate the first preferred embodiment of an athletic protective cup according to the present invention. The protective cup includes: a molded cup-shaped main body 2 of a resin material, the cup-shaped main body 2 having a peripheral edge 21, upper and lower segments 22, 23 having different colors, and an intermediate transition segment 24 interconnecting the upper and lower segments 22, 23 (see FIGS. 5-7), the upper and lower segments 22, 23 and the intermediate transition segment 24 cooperatively forming the cup-shaped main body 2, the peripheral edge 21 having top and bottom sides 211, 212, the upper segment 22 extending curvedly from the top side 211 of the peripheral edge 21 to the intermediate transition segment 24, the lower segment 23 extending curvedly from the intermediate transition segment 24 to the bottom side 212 of the peripheral edge 21, the lower segment 23 having a wall thickness (w1) less than that (w2) of the upper segment 22 so that the lower segment 23 is more pliable than the upper segment 22 and that the upper segment 22, is more rigid than the lower segment 23; an upper lip 25 extending from the top side 211 of the peripheral edge 21 in a direction away from the intermediate transition segment 24; a lower lip 26 extending from the bottom side 212 of the peripheral edge 21 in a direction away from the intermediate transition segment 24; and an elastic pad body 3 having a loop-shaped lip 31 connected to the peripheral edge 21 of the cup-shaped main body 2 and molded over the upper and lower lips 25, 26.

The cup-shaped main body 2 further has an inner surface 201 and an outer surface 202. The elastic pad body 3 further has a cup-shaped base layer 32 surrounded by and connected to the loop-shaped lip 31 and molded over the inner surface 201 of the cup-shaped main body 2.

A plurality of upper ventilation holes 220 extend through the upper segment 22 of the cup-shaped main body 2 and the cup-shaped base layer 32. A plurality of lower ventilation holes 230 extend through the lower segment 23 of the cup-shaped main body 2 and the cup-shaped base layer 32.

A plurality of slanted retaining protrusions 235 are disposed at the lower segment 23 of the cup-shaped main body 2, and protrude from the inner surface 201 of the cup-shaped main body 2 through the cup-shaped base layer 32.

The intermediate transition segment 24 has upper and lower ends 241, 242 adjacent to the upper and lower segments 22, 23, respectively, and a wall thickness (w3) that gradually decreases from the upper end 241 to the lower end 242. In order to provide a sufficient rigidity, the wall thickness (w2) of the upper segment 22 is preferably equal to or greater than 3 mm, and in order to provide a desired flexibility, the wall thickness (w1) of the lower segment 23 is preferably equal to or less than 1.5 mm. In this embodiment, the wall thickness (w2) of the upper segment 22 of the cup-shaped main body 2 is substantially uniform and is equal to 3.0 mm, the wall thickness (w1) of the lower segment 23 of the cup-shaped main body 2 is substantially uniform and is equal to 1.5 mm, and the cup-shaped base layer 32 has a substantially uniform wall thickness (w4) of 2.0 mm.

The cup-shaped main body 2, the upper and lower lips 25, 26 and the elastic pad body 3 can be formed by injection molding techniques in a conventional manner. For the sake of brevity, formation of the cup-shaped main body 2, the upper and lower lips 25, 26 and the elastic pad body 3 through the injection molding techniques will not be described in detail herein.

The upper and lower lips 25, 26 can be integrally formed with the cup-shaped main body 2 through injection molding of the resin material. Preferably, the resin material is selected from polypropylene, high density polyethylene, polybutylene terephthalate, acrylonitrile butadiene styrene (ABS), polycarbonate (PC), and ABS/PC alloys. Preferably, the elastic pad body 3 is made from an elastic material, such as styrene butadiene rubber (SBR) and thermoplastic elastomers.

Figure 8:
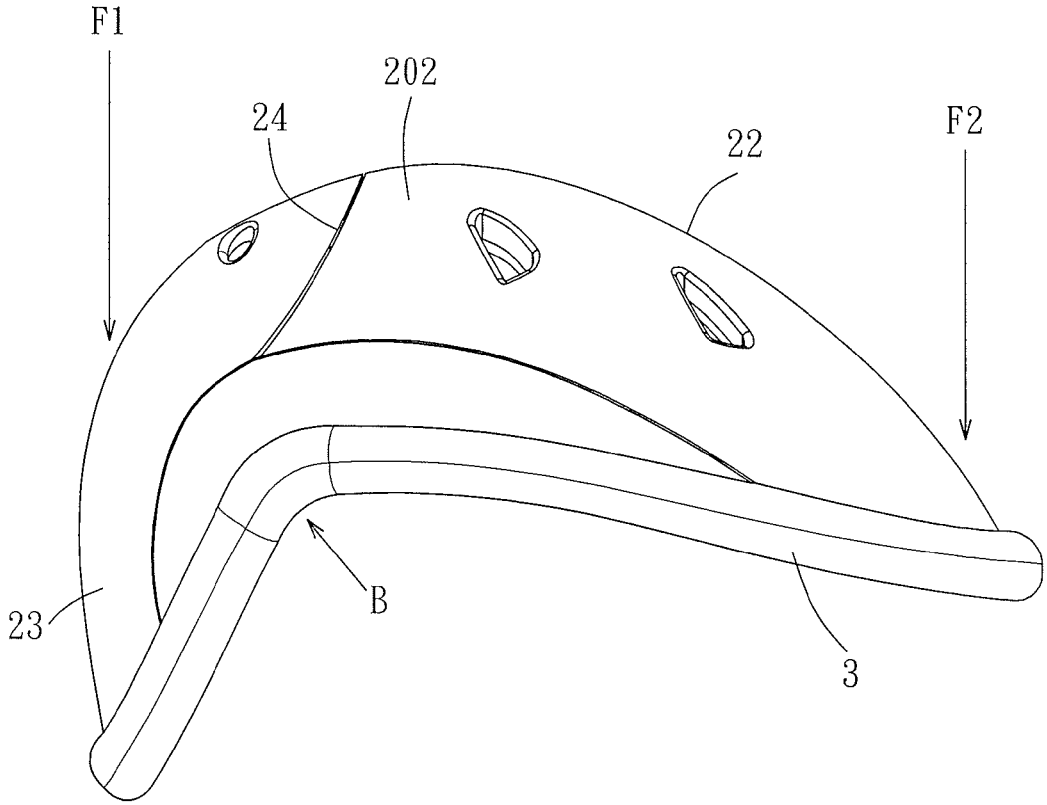
FIG. 8 is a perspective view illustrating a state where bending occurs at a lower segment of the first preferred embodiment when external forces are applied to two ends of the preferred embodiment.

FIG. 8 illustrates a state of the preferred embodiment where bending (indicated by arrow B) occurs at a portion of the lower segment 23 adjacent to the intermediate transition segment 24 when two external forces (F1 and F2) are applied to an end portion of the upper segment 22 and an end portion of the lower segment 23.

Figure 9:
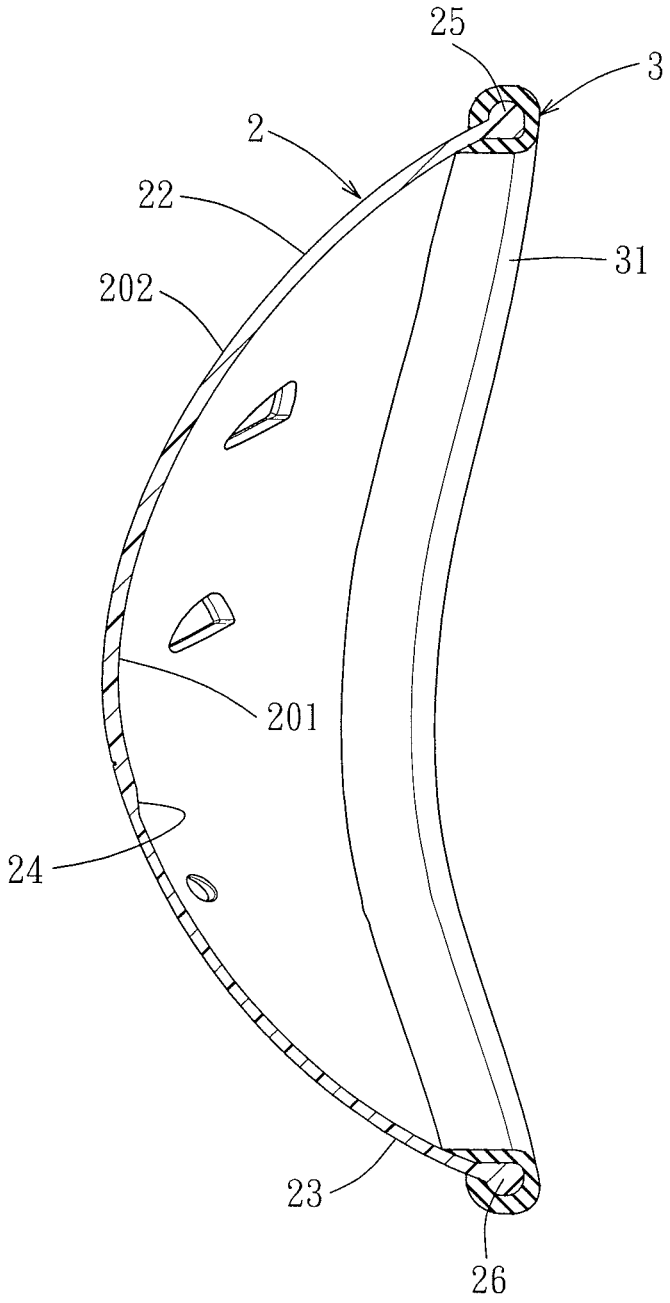
FIG. 9 is a sectional view of the second preferred embodiment of a protective cup according to the present invention.

FIG. 9 illustrates the second preferred embodiment of an athletic protective cup according to the present invention. The second preferred embodiment differs from the previous embodiment in that the elastic pad body 3 solely includes the loop-shaped lip 31 (i.e., the cup-shaped base layer 32 is excluded) that is molded over the peripheral edge 21 of the cup-shaped main body 2 and the upper and lower lips 25, 26.

Since the wall thickness (w1) of the lower segment 23 is less than the wall thickness (w2) of the upper segment 22 of the cup-shaped main body 2, the protective cup can become flexible at the lower segment 23 while retaining the rigidity at the upper segment 22, thereby alleviating the aforesaid drawbacks with respect to the restricted movement and the discomfort caused to the wearer as encountered by the use of an entirely rigid protective cup. In addition, since the upper and lower segments 22, 23 and the intermediate transition segment 24 are made from the same resin material, formation of the protective cup can be carried out in one single injection molding operation.

While the present invention has been described in connection with what is considered the most practical and preferred embodiments, it is understood that this invention is not limited to the disclosed embodiment but is intended to cover various arrangements included within the spirit and scope of the broadest interpretation so as to encompass all such modifications and equivalent arrangements.

What is claimed is:

1. A protective cup comprising:

a molded cup-shaped main body of a resin material, said cup-shaped main body having a peripheral edge, upper and lower segments, and an intermediate transition segment interconnecting said upper and lower segments, said upper and lower segments and said intermediate transition segment cooperatively forming said cup-shaped main body, said peripheral edge having top and bottom sides, said upper segment extending curvedly from said top side of said peripheral edge to said intermediate transition segment, said lower segment extending curvedly from said intermediate transition segment to said bottom side of said peripheral edge, said lower segment having a wall thickness less than that of said upper segment so that said lower segment is more pliable than said upper segment and that said upper segment is more rigid than said lower segment; and an elastic pad body having a loop-shaped lip connected to said peripheral edge of said cup-shaped main body.

2. The protective cup of claim 1, wherein said intermediate transition segment has upper and lower ends adjacent to said upper and lower segments, respectively, and a wall thickness that gradually decreases from said upper end to said lower end.

3. The protective cup of claim 1, further comprising an upper lip extending from said top side of said peripheral edge in a direction away from said intermediate transition segment, and a lower lip extending from said bottom side of said peripheral edge in a direction away from said intermediate transition segment, said loop-shaped lip being molded over said upper and lower lips.

4. The protective cup of claim 1, wherein said cup-shaped main body further has an inner surface, said elastic pad body further having a cup-shaped base layer surrounded by and connected to said loop-shaped lip and molded over said inner surface of said cup-shaped main body.

* * * * *